US007985300B2

(12) United States Patent
Lee et al.

(10) Patent No.: US 7,985,300 B2
(45) Date of Patent: Jul. 26, 2011

(54) DISHWASHER AND ASSEMBLY METHOD THEREOF

(75) Inventors: Tae Hee Lee, Bucheon-si (KR); Yang Hoon Chung, Incheon (KR); Young Hwan Park, Seoul (KR); Si Moon Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 983 days.

(21) Appl. No.: 11/396,452

(22) Filed: Apr. 4, 2006

(65) Prior Publication Data

US 2006/0219272 A1 Oct. 5, 2006

(30) Foreign Application Priority Data

Apr. 4, 2005 (KR) ..... 10-2005-0028213
Apr. 6, 2005 (KR) ..... 10-2005-0028608

(51) Int. Cl.
*B08B 3/00* (2006.01)

(52) U.S. Cl. ..... 134/56 D; 134/57 D

(58) Field of Classification Search ..... None
See application file for complete search history.

(56) References Cited

U.S. PATENT DOCUMENTS

| | | | | |
|---|---|---|---|---|
| 3,837,917 | A * | 9/1974 | Jenkins et al. | 134/144 |
| 4,730,630 | A * | 3/1988 | Ranft | 134/111 |
| 5,377,707 | A * | 1/1995 | Young, Jr. | 134/104.1 |
| 6,817,043 | B2 * | 11/2004 | Zars | 4/504 |
| 2004/0250837 | A1 * | 12/2004 | Watson et al. | 134/25.2 |
| 2005/0263174 | A1 | 12/2005 | Yoon et al. | |
| 2006/0076037 | A1 | 4/2006 | Kim et al. | |

FOREIGN PATENT DOCUMENTS

| | | |
|---|---|---|
| KR | 200122437 | 3/1998 |
| KR | 10-2004047015 | 6/2004 |

OTHER PUBLICATIONS

English language Abstract of KR 10-2004-047015.
English language Abstract of KR 20-0122437.

* cited by examiner

*Primary Examiner* — Michael Barr
*Assistant Examiner* — Jason Y Ko
(74) *Attorney, Agent, or Firm* — McKenna Long & Aldridge LLP

(57) ABSTRACT

A dishwasher and assembly method thereof are disclosed, by which an overall height of the dishwasher is reduced, by which water can stably flow and by which assembly efficiency can be enhanced. The present invention includes a sump accommodating water therein and a wash pump assembled to the sump in a lateral direction to circulate the water within the sump.

8 Claims, 11 Drawing Sheets

DISHWASHER AND ASSEMBLY METHOD THEREOF

This application claims the benefit of Korean Patent Application Nos. 2005-0028213, filed Apr. 4, 2005 and 2005-0028608, filed Apr. 6, 2005, which are herein expressly incorporated by reference in their entireties.

BACKGROUND OF THE INVENTION

1. Field of the Invention

The present invention relates to a dishwasher, and more particularly, to a dishwasher and assembly method thereof. Although the present invention is suitable for a wide scope of applications, it is particularly suitable for providing a wash pump having a new structure.

2. Discussion of the Related Art

Generally, a dishwasher is a device for washing and drying tableware in a manner of spraying water at high pressure.

FIG. 1 is a cross-sectional diagram of a dishwasher according to a related art.

Referring to FIG. 1, a dishwasher consists of a tub 1, an upper spray arm 4, a lower spray arm 5, an upper rack 6, a lower rack 7 and a drive module 10.

A wash space is provided within the tub 1 to wash tableware therein. And, the upper and lower spray arms 4 and 5 are provided to upper and lower parts within the tub 1, respectively. Moreover, the tableware washed by water sprayed from the upper and lower spray arms 4 and 5 is accommodated in the upper and lower racks 6 and 7.

Meanwhile, the water sprayed via the spray arms 4 and 5 is pumped by the drive module 10 that consists of a sump and a pump. Water is stored in the sump. The water stored in the sump is pumped by the pump to move to the spray arms 4 and 5 along upper and lower guide pipes 2 and 3, respectively.

FIG. 2 is an exploded perspective diagram of a drive module of a dishwasher according to a related art.

Referring to FIG. 2, a drive module 10 consists of a sump 20, a heater 30, a wash pump and a drain pump 50. Water is stored in the sump 20, the heater 30 is provided over the sump to heat the water. After completion of washing, the water is externally discharged by the drain pump 50.

The wash pump consists of a motor 40, an impeller 42 and an impeller housing 60. The impeller 42 is accommodated in the impeller housing 60 provided over the sump 20 and is connected to the motor 40 provided under the sump 20 via a rotational shaft 41.

A garbage chamber 70 is provided over the impeller housing 60. If the impeller 42 is rotated by the driven motor 40, the water is introduced into one side of the garbage chamber 70 and then moves away into a garbage passage or a spray arm selectively according to a switching of a control valve 26. The water having moved to the spray arm is used in washing tableware. The water introduced into the garbage passage is purified in a following manner. In this case, the impeller housing 60 is formed of a separate part and the garbage chamber 70 is assembled to a circumference of the impeller housing 60. A cover portion 75 projected upward is provided to a central part of the garbage chamber 70 to cover the impeller 42. And, the cover portion 75 enables a total volume of the garbage chamber to be reduced.

A filter frame 80 is provided over the garbage chamber 70. A multitude of holes 82 are formed at an outer rim of the filter frame 80. A filter housing 90 is provided over the filter frame 80. And, a filter 94 is provided to the filter housing 90 to filter off garbage from the water. In this case, the filter 94 is provided over the garbage chamber 70. Preferably, the filter 94 is configured to cover a part except the cover portion 75 projected from the central part of the garbage chamber 70 to effectively purify the water containing garbage.

So, the water introduced into the garbage passage overflows onto the filter 94 to be purified and is then recovered to the sump 20 via the holes 82 provided to the filter frame 80.

And, a guide pipe support member 96 is assembled as a separate part to a central part of the filter housing 90 to be connected to a lower guide pipe ('3' in FIG. 1)

However, the related art dishwasher has the following problems.

First of all, the motor and impeller of the wash pump used for the dishwasher are assembled or dissembled in a vertical direction, thereby having difficulty in being assembled. In particular, since the impeller housing is provided as the separate part, a sealing between the impeller housing and the garbage chamber is configured unstable. Hence, the leakage of water brings about a pressure loss.

Secondly, since the garbage chamber is provided along the circumference of the impeller housing, the volume of the garbage chamber is reduced due to the cover portion projected upward from the central part. Hence, limitation is put on increasing a quantity of the water purified by the filter in overflowing through the garbage chamber.

Thirdly, since the impeller and the motor are connected in a vertical direction, a total height of the drive module is raised. Hence, the wash space within the tub is reduced.

Fourthly, since the motor is provided under the sump, it is difficult to stably fix the sump and the motor thereto.

SUMMARY OF THE INVENTION

Accordingly, the present invention is directed to a dishwasher and assembly method thereof that substantially obviate one or more problems due to limitations and disadvantages of the related art.

An object of the present invention is to provide a dishwasher and assembly method thereof, by which an overall height of the dishwasher is reduced, by which water can stably flow and by which assembly efficiency can be enhanced.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a dishwasher according to the present invention includes a sump accommodating water therein and a wash pump assembled to the sump in a lateral direction to circulate the water within the sump.

Preferably, the wash pump includes an inlet sucking the water within the sump and an outlet discharging the sucked water into the sump, wherein the sump comprises a connecting port and a supply port corresponding to the inlet and the outlet, respectively.

More preferably, the inlet and the outlet are provided parallel to each other. More preferably, the wash pump is assembled to the sump in a manner of connecting the inlet and the outlet to the connecting port and the supply port in direct, respectively. More preferably, a cross-sectional area of the inlet is greater than that of the outlet.

More preferably, a height of the inlet is smaller than a width of the inlet.

Preferably, the wash pump includes a motor, an impeller rotated by the motor, and an impeller housing accommodating the impeller.

More preferably, the wash pump further includes a front casing provided to a front side of the impeller housing, the front casing having an inlet sucking the water within the sump and an outlet discharging the sucked water into the sump.

Preferably, the dishwasher further includes a fixing holder fixing the wash pump.

More preferably, the fixing holder is bent to have an 'L' shape. More preferably, one portion of the bent fixing holder is assembled to a rear side of the wash pump and the other portion of the bent fixing holder is assembled to a base of the dishwasher. More preferably, an alignment piece is provided to the fixing holder to align a locking position and an alignment piece coupling portion is provided to the base to correspond to the alignment piece.

More preferably, the sump further includes a supply passage communicating with the supply port and a spray arm spraying the water. More preferably, the dishwasher further includes a garbage chamber having a passage for supplying the water to a spray arm spraying the water from the supply port. More preferably, the garbage chamber further includes a passage for purifying the water introduced from the supply port.

Preferably, the wash pump further includes a screen filtering off garbage from the sucked water.

More preferably, the screen is provided to the inlet via which the water is sucked into the wash pump. More preferably, the screen includes a mesh type screen having a multitude of perforated holes.

More preferably, a passing hole is formed at a center of the screen to enable a motor shaft of the wash pump to pass through the passing hole. More preferably, a screen bearing is provided between the passing hole and the motor shaft.

More preferably, the wash pump further includes a pulverizer pulverizing the garbage contained in the water introduced into the screen. More preferably, the pulverizer is provided to a front end of the screen to be rotated via a motor shaft of the wash pump.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
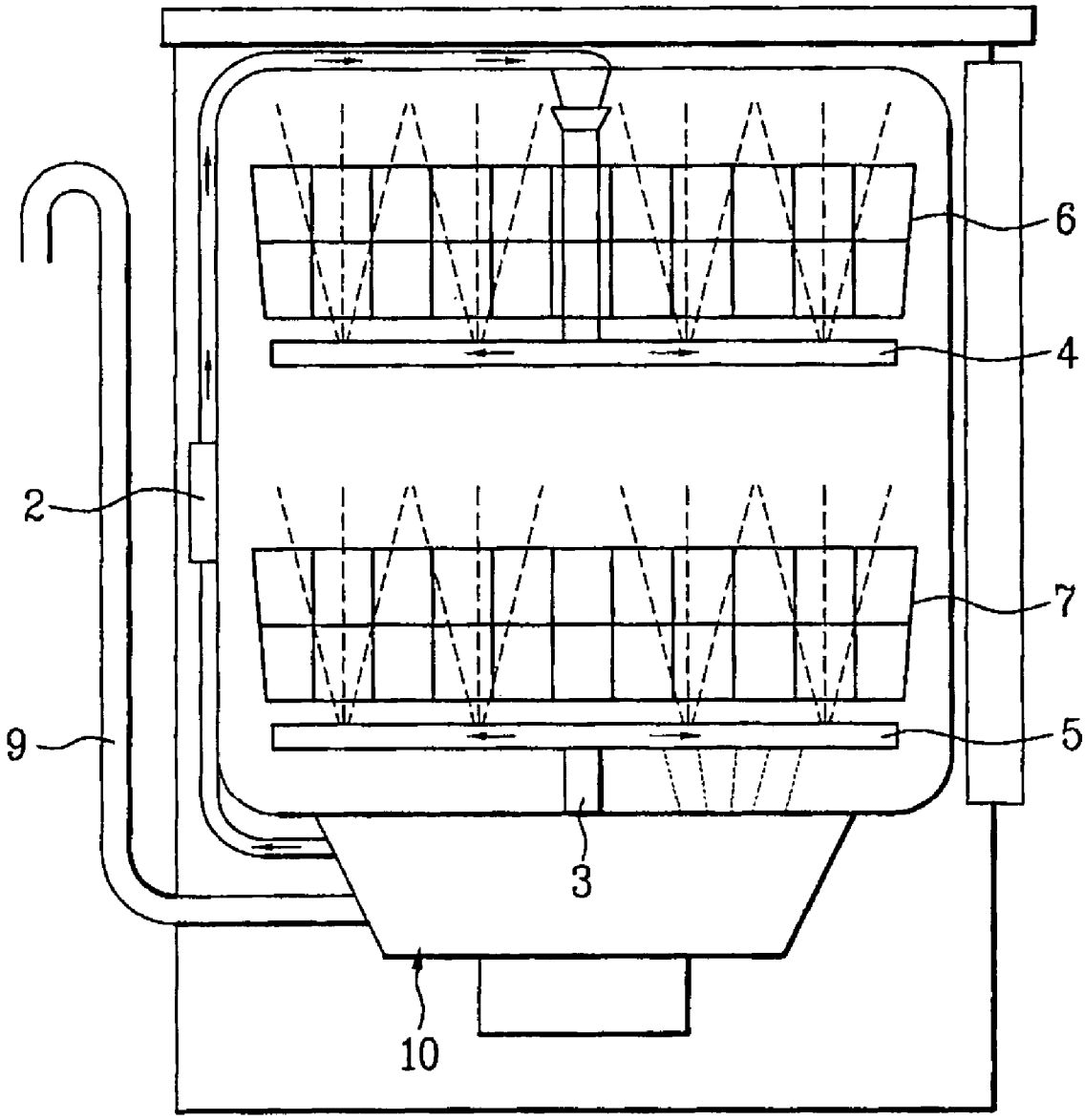
FIG. 1 Related Art
FIG. 1 is a cross-sectional diagram of a dishwasher according to a related art.
Figure 2:
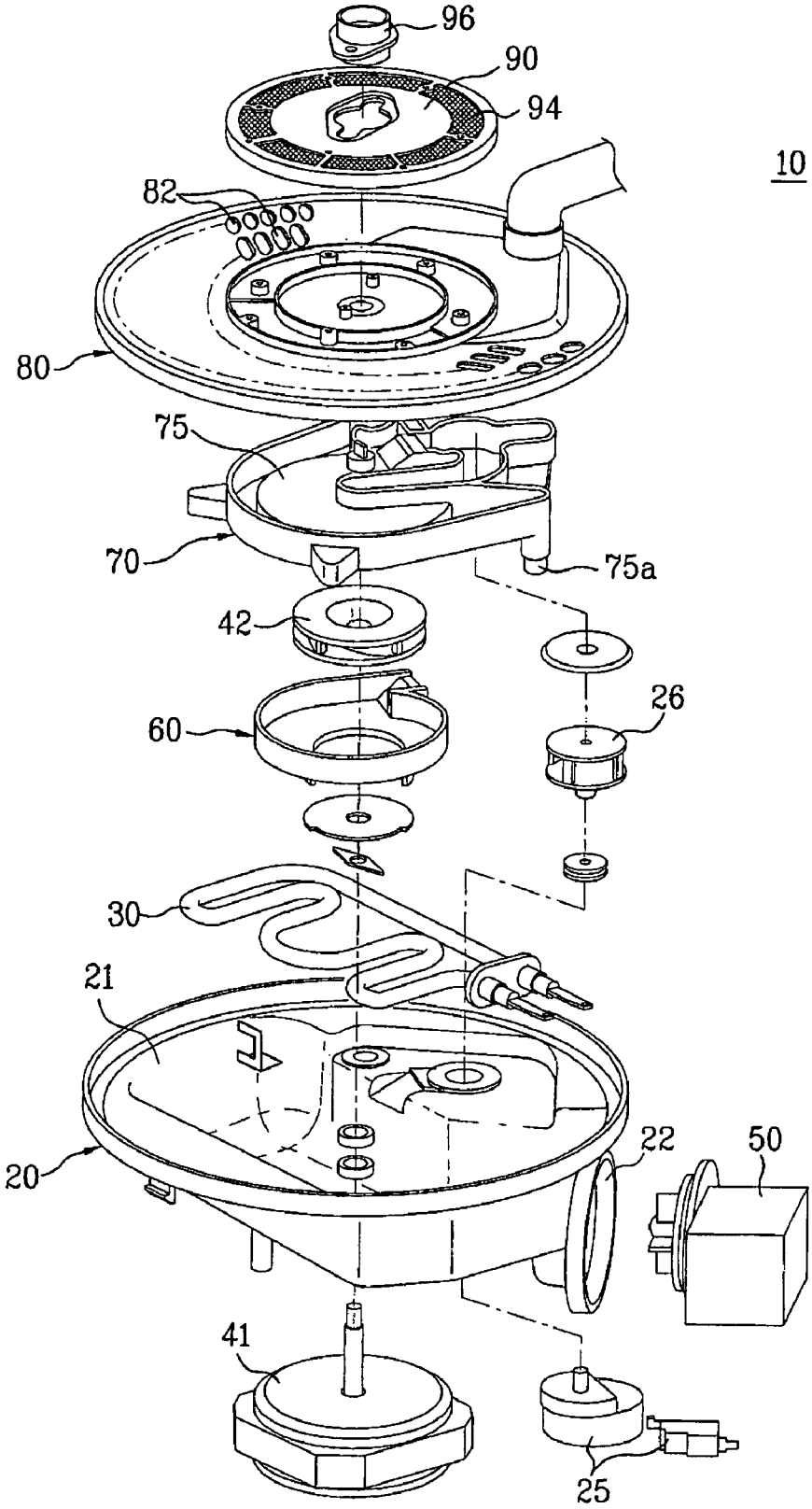
FIG. 2 Related Art
FIG. 2 is an exploded perspective diagram of a drive module of a dishwasher according to a related art.
Figure 3:
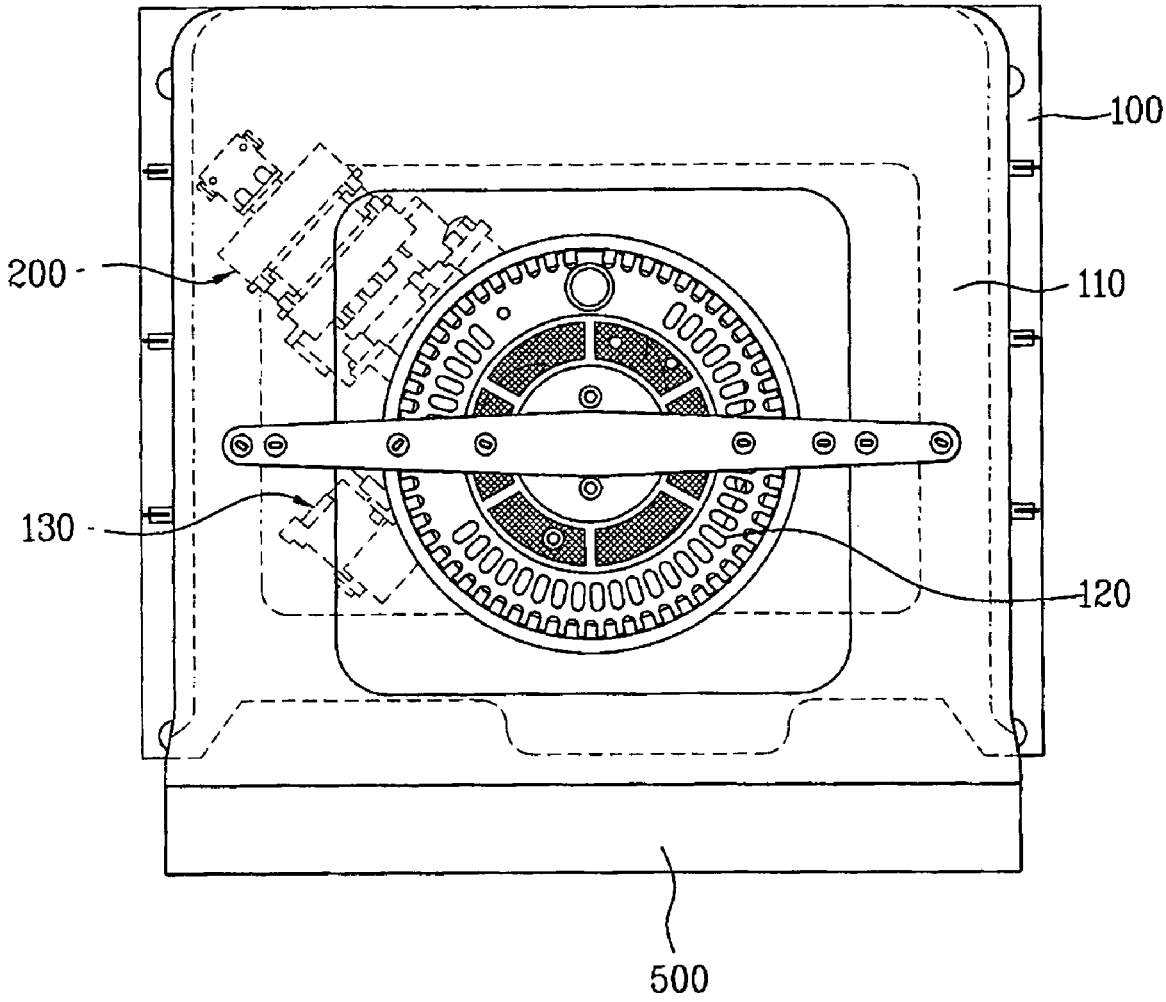
FIG. 3 is a layout of a dishwasher according to the present invention.
Figure 4:
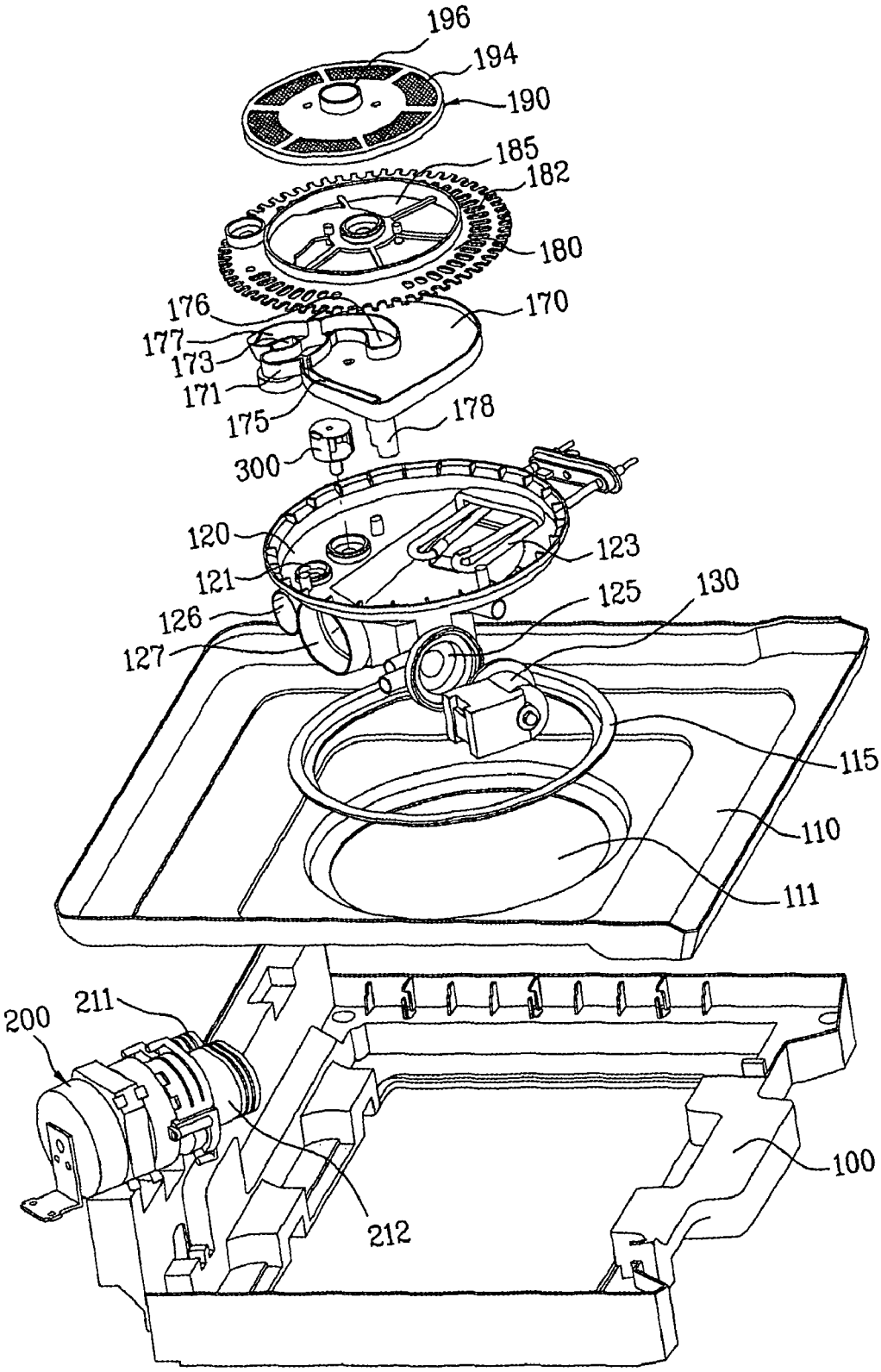
FIG. 4 is an exploded perspective diagram of a drive module of a dishwasher according to the present invention.

FIG. 3 is a layout of a dishwasher according to the present invention and FIG. 4 is an exploded perspective diagram of a drive module of a dishwasher according to the present invention.

Referring to FIG. 3 and FIG. 4, a drive module of a dishwasher according to the present invention includes a horizontal type wash pump 200 and a sump 120.

Preferably, a heater is provided to the sump 120 to heat water.

A rim of the sump 120 is inserted in a hole 111 formed at a central part of a tub bottom plate 110 to be fixed thereto.

A base 100 is provided under the tub bottom plate 110.

And, a packing member 115 is provided between a rim of the hole 111 and the rim of the sump 120 to prevent water leakage.

A prescribed gap is provided between a lower surface of the tub bottom plate 110 and an upper surface of the base 100. And, the horizontal type wash pump 200 is placed in a space provided by the prescribed gap. Preferably, the sump 120 is inserted in the hole 111 at the tub bottom plate 110, the horizontal wash pump 200 is assembled to the sump 120, and the tub bottom plate 110 is then loaded on the base 100.

Through this, the wash pump 200 can be assembled in a simpler manner. Hence, productivity of the dishwasher can be enhanced.

Preferably, an inlet 212, into which the water is sucked, and an outlet 211, from which the sucked water is discharged by being pressurized, are provided parallel to each other to the horizontal type wash pump 200.

A connecting port 127 and a supply port 126 are provided parallel to each other to the sump 120 to be connected to the inlet 212 and the outlet 211, respectively.

In particular, water is stored in the sump 120. The water is sucked into the horizontal type wash pump 200 via the connecting port 127 and the inlet 212. The sucked water is pressurized by the impeller and is then introduced into the supply port 126 via the outlet 211.

Preferably, the inlet 212 and the outlet 211 are directly connected to the connecting port 127 and the supply port 126, respectively. Through this, it is unnecessary to assemble additional water hoses thereto. Hence, the corresponding assembly work can be facilitated.

Preferably, the connecting port 127 and the supply port 126 are provided parallel to each other in a direction parallel to a horizontal ground surface. Through this, an overall height of the sump 120 can be reduced. Moreover, since the horizontal type wash pump 200 is assembled to the sump 120 while lying in a horizontal direction, an inner space of the dishwasher can be practically utilized.

Meanwhile, a garbage chamber 170 is provided to an upper part of the sump 120. In this case, since an impeller housing, which will be explained later, is provided within the horizontal type wash pump, a configuration of the upper part of the sump can be simplified.

A configuration of the horizontal type wash pump pumping the water is explained in detail as follows.

Figure 5:
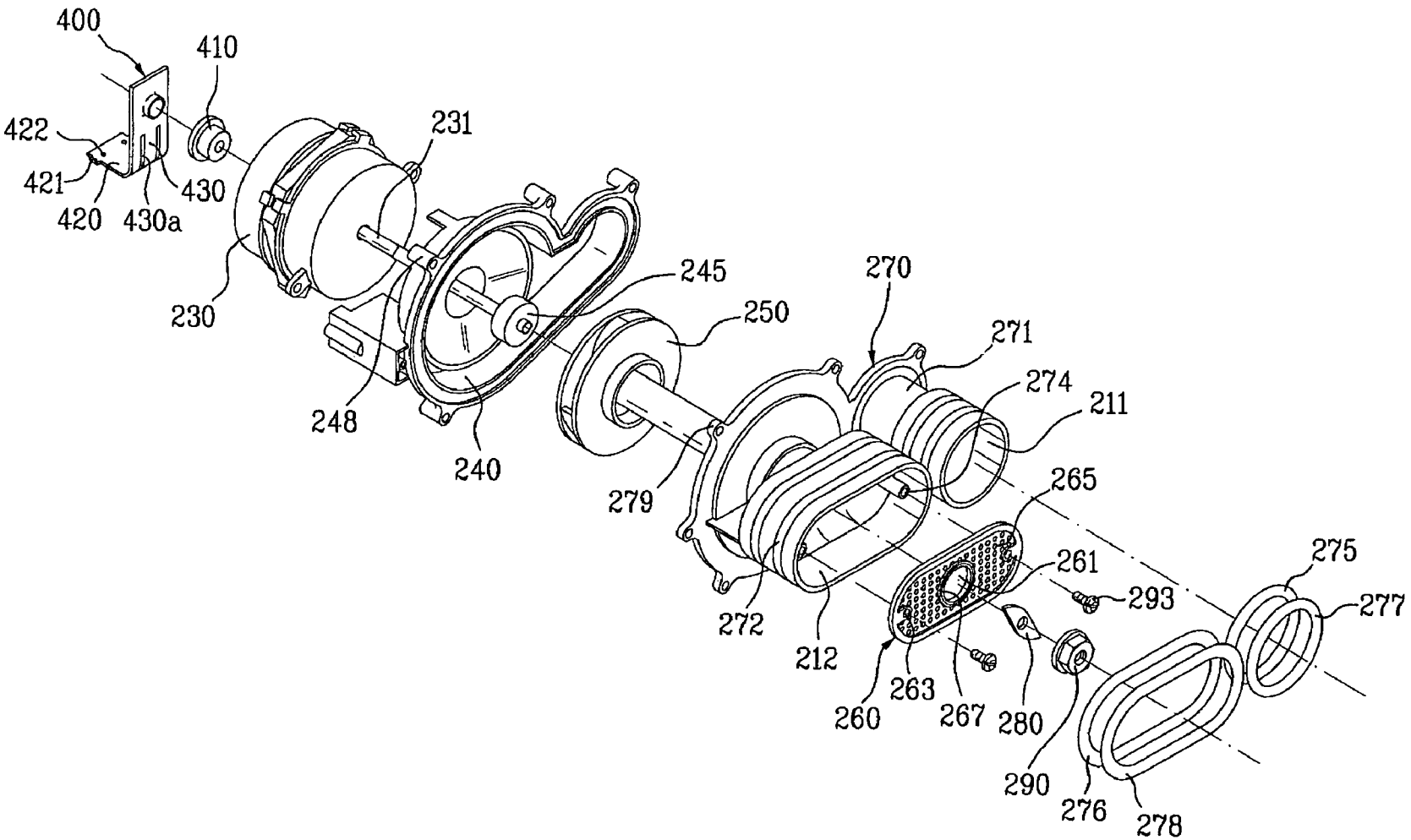
FIG. 5 is an exploded perspective diagram of a wash pump of a dishwasher according to the present invention.

FIG. 5 is an exploded perspective diagram of a wash pump of a dishwasher according to the present invention.

Referring to FIG. 5, a horizontal type wash pump 200 includes an impeller 250, an impeller housing 240 and a front casing 270.

Preferably, a rear side of the impeller housing 240 is fixed to a motor 230. And, the impeller 250 is rotatably connected to the motor 230.

The motor 230 includes a BLDC motor. Preferably, a rear side of the motor 230 is fixed to a frame of a dishwasher by a fixing holder 400.

The impeller 250 is accommodated in the impeller housing 240 to be connected to the motor 230 via a rotational shaft 231. And, a sealing member 245 is provided to a connecting part between the impeller 250 and the rotational shaft 231 to prevent leakage of water.

An internal space of the impeller housing 240 is partitioned in partitioned to communicate with the inlet 212 and the outlet 211.

The front casing 270 is directly assembled to a front side of the impeller housing 240. And, the inlet 212 and the outlet 211 are built in one body of one casing 270 to be partitioned from each other.

Once the impeller 250 rotates, water introduced via the inlet 212 is pressurized within the impeller housing 240 and is then pumped via the outlet 211.

Preferably, a cross-sectional area of the inlet 212 is formed smaller than that of the outlet 211 to facilitate a flow of the pressurized water smoothly.

A screen 260 is provided to a front end of the inlet 212 of the pump to filter off garbage having a relatively large volume from the water introduced into the inlet 212.

A passing hole 261 is formed at a center of the screen 260 to be penetrated by the motor (rotational) shaft 231 of the wash motor 230.

And, a multitude of perforated holes 265 are formed at the screen 260 around the passing hole 261.

At least one locking hole 263 is formed at a rim of the screen 260 to enable the screen 260 to be locked to the pump inlet 212 by at least one locking screw 293. And, at least one projected locking boss 274 is formed inside the pump inlet 212 to oppose the at least one locking hole 263. The at least one locking screw 293 passes through the corresponding locking hole 263 and is then locked into the corresponding locking boss 274 provided to the front casing 270.

A screen bearing 267 is installed on an inner circumference of the passing hole 261 to reduce friction with the motor shaft 231.

A pulverizer 280 is provided in front of the screen 260. The pulverizer is connected to the motor shaft 231. And, the pulverizer is rotated to pulverize garbage. Moreover, the motor shaft 231 passing through the pulverizer 280 is fixed to the pulverizer by a nut 290.

In the present embodiment, the pulverizer 280 has a streamlined shape. Yet, a shape of the pulverizer 280 can be modified into arbitrary polygonal shapes in the present invention.

Meanwhile, it is preferable that the inlet 212 has a flat shape. This is to restrict a height of the inlet 212 having a relatively large size to a predetermined level or lower. In particular, a width of a cross-section of the inlet 212 is formed greater than a height of the inlet 212. And, the connecting port ('127' in FIG. 4) provided to the sump is configured to have a shape corresponding to that of the inlet 212 to be assembled to the inlet 212.

A fixing structure between the wash motor and the sump is explained with reference to FIGS. 3 to 5 as follows.

First of all, a plurality of hole portions 248 and 279 are formed at the impeller housing 240 and the front casing 270 in circumferential directions of the impeller housing 240 and the front casing 270, respectively. A plurality of the hole portions 248 of the impeller housing 240 are spaced apart from each other and a plurality of the hole portions 279 of the front casing 270 are spaced apart from each other. And, a screw or bolt is inserted into each of a plurality of the hole portions 248 and 279. Moreover, a plurality of locking portions (not shown in the drawing) are provided to the rims of the connecting and supply ports provided to the sump to be locked by the bolts or screws, respectively. Hence, if the bolt passing through the corresponding hole portions 248 and 270 is fitted into the corresponding locking portions, the front casing 270 is clamped between the outer circumferences of the impeller housing 240 and the sump to be fixed thereto.

An inlet guide port 272 and an outlet guide port 271 are provided to a front side of the front casing 270 to be projected from the front casing 270. Preferably, the inlet guide port 272 and the outlet guide port 271 are configured to be fitted into the connection port 127 and the supply port 126, respectively.

Grooves, into which waterproof rings 275 and 276 preventing water leakage are fitted, and grooves, into which vibration-resistant rings 277 and 278 cutting off vibration from the motor 230 are fitted, are provided to outer circumferences of the guide ports 271 and 272, respectively.

So, as the bolts are locked, the horizontal type wash pump 200 is fixed to a lateral side of the sump 120. And, the inlet and the outlet communicate with the connecting port and the supply port, respectively.

Meanwhile, in case that the motor 230 is not stably fixed, water leakage takes place and a noise is considerably generated. To prevent the water leakage and the noise, it is preferable that a rear side of the motor 230 is stably fixed to the base by the fixing holder 400. More preferably, a vibration-resistant packing member 410 is provided between the rear side of the motor 230 and the fixing holder 400.

The fixing holder 400, as shown in FIG. 5, is bent to have a 'L' shape. And, one portion 430 of the bent fixing holder 400 is assembled to the rear side of the wash pump 200. In particular, the fixing holder 400 is preferably locked to the rear side of the motor 230 using a bolt and the like. To support rigidity of the bent portion of the fixing holder 400, a bead 430*a* is provided to the bent portion.

Figure 6:
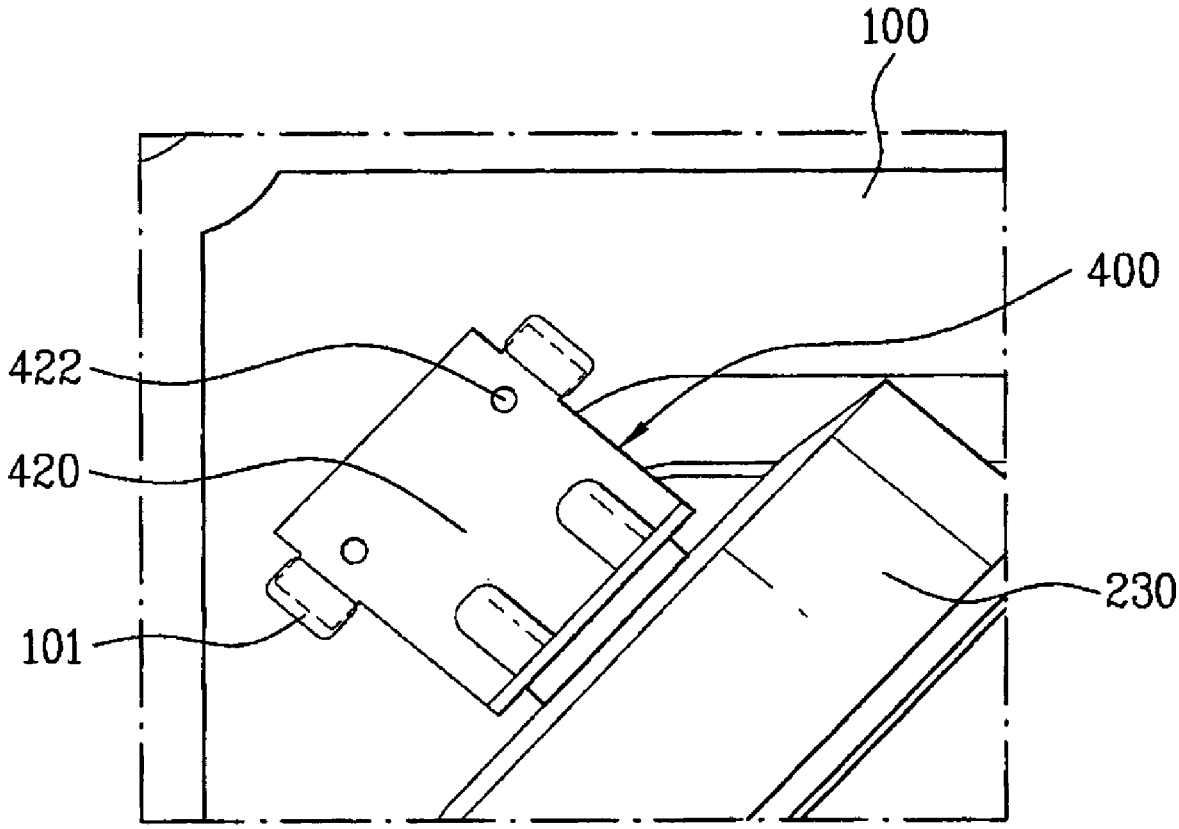
FIG. 6 is a top-view diagram of a fixing structure of a wash motor of a dishwasher according to the present invention.

The other portion 420 of the bent fixing holder 400, as shown in FIG. 6, is fixed to the base. For this, holes 422 are formed at the other portion 420 and the base ('100' in FIG. 3). Screws are locked into the holes 422 to fix the other portion 420 of the bent fixing holder 400 to the base 100.

Preferably, an alignment piece 421 is provided to the fixing holder 400. Preferably, an alignment piece coupling portion 101 is provided to the base 100. Hence, as the alignment piece 421 is fitted into the alignment piece coupling portion 101, a screw locking position can be aligned.

In particular, once the alignment piece 421 of the fixing holder 400 is inserted in the alignment piece coupling portion 101, the holes 422 are automatically aligned. In this case, the alignment piece coupling portion 101 is formed by lancing to have the alignment piece 421 inserted therein. Through this, it is able to reduce the time taken to align the holes 422 provided to the other portion 420 and the base 100 with each other. And, the motor 230 can be fixed more stably.

A flow of the water on the sump 120 is explained in detail with reference to FIG. 7 and FIG. 8 as follows.

Figure 7:
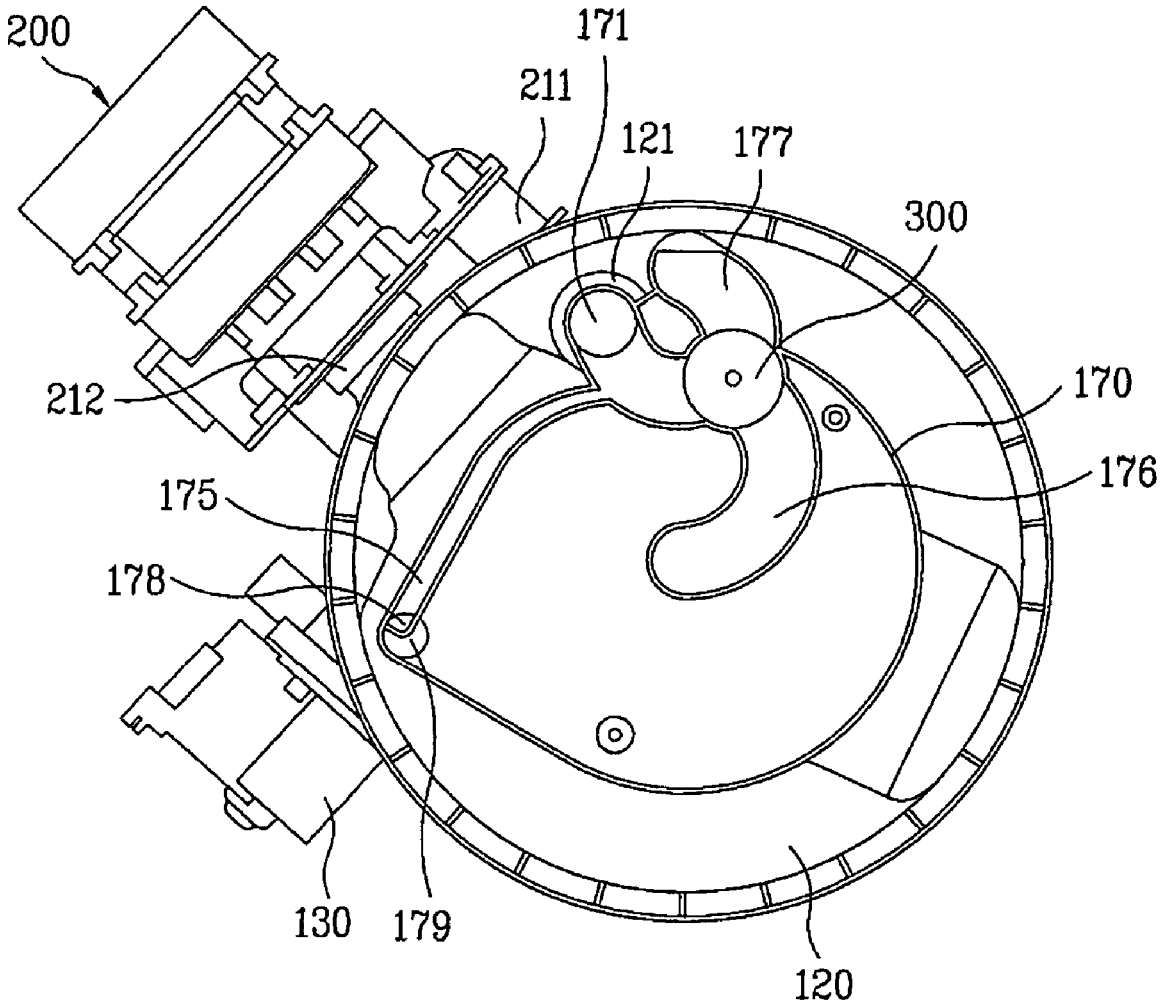
FIG. 7 is a layout of an assembly of a sump and garbage chamber of a dishwasher according to the present invention.
Figure 8:
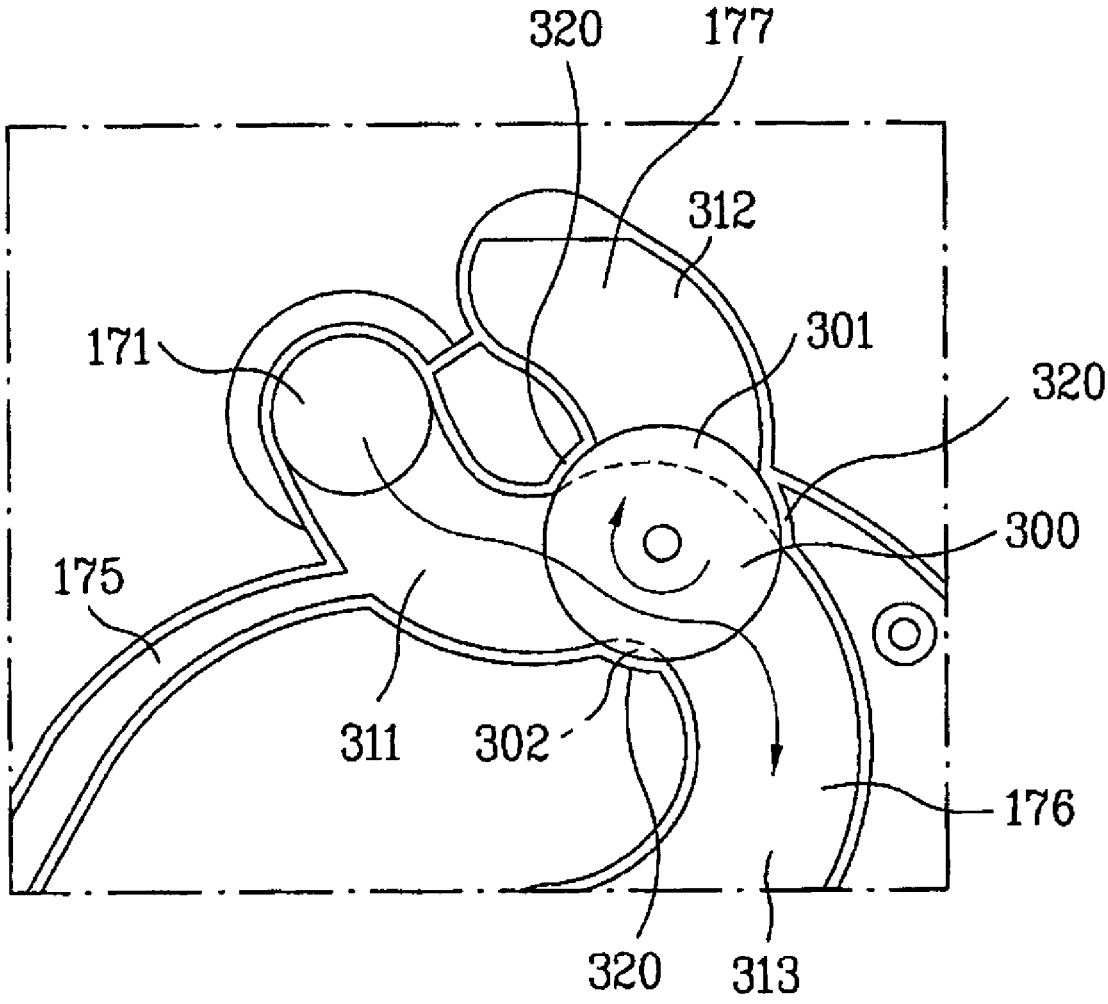
FIG. 8 is a layout of a passage of a dishwasher according to the present invention.

FIG. 7 is a layout of an assembly of a sump and garbage chamber of a dishwasher according to the present invention and FIG. 8 is a layout of a passage of a dishwasher according to the present invention.

Referring to FIG. 7 and FIG. 8, water pumped through the supply port 126 is introduced into a water introducing portion 171 of the garbage chamber 170 via a supply passage 121 provided to the sump 120. In this case, it is preferable that an O-ring formed of a rubber and the like is provided between the supply passage 121 and the garbage chamber 170 to prevent water leakage.

Preferably, the water introducing portion 171 is outwardly projected from the garbage chamber 170. This is to prevent a space for storing water containing garbage from being reduced in case that the water introducing portion 171 is located at a central part of the garbage chamber 170.

Meanwhile, an introducing passage extending to be connected to the water introducing portion 171 and a pair of water passages 176 and 177 connected to at least one wash arm are provided to the garbage chamber 170.

A pair of the water passages 176 and 177 guides the water introduced via the water introducing portion 171 to upper and lower arms, respectively.

The water introduced into the water introducing portion 171 is selectively discharged to the water passage 176 connected to the upper arm or the other water passage 177 connected to the lower arm by a control valve 300.

Figure 9:
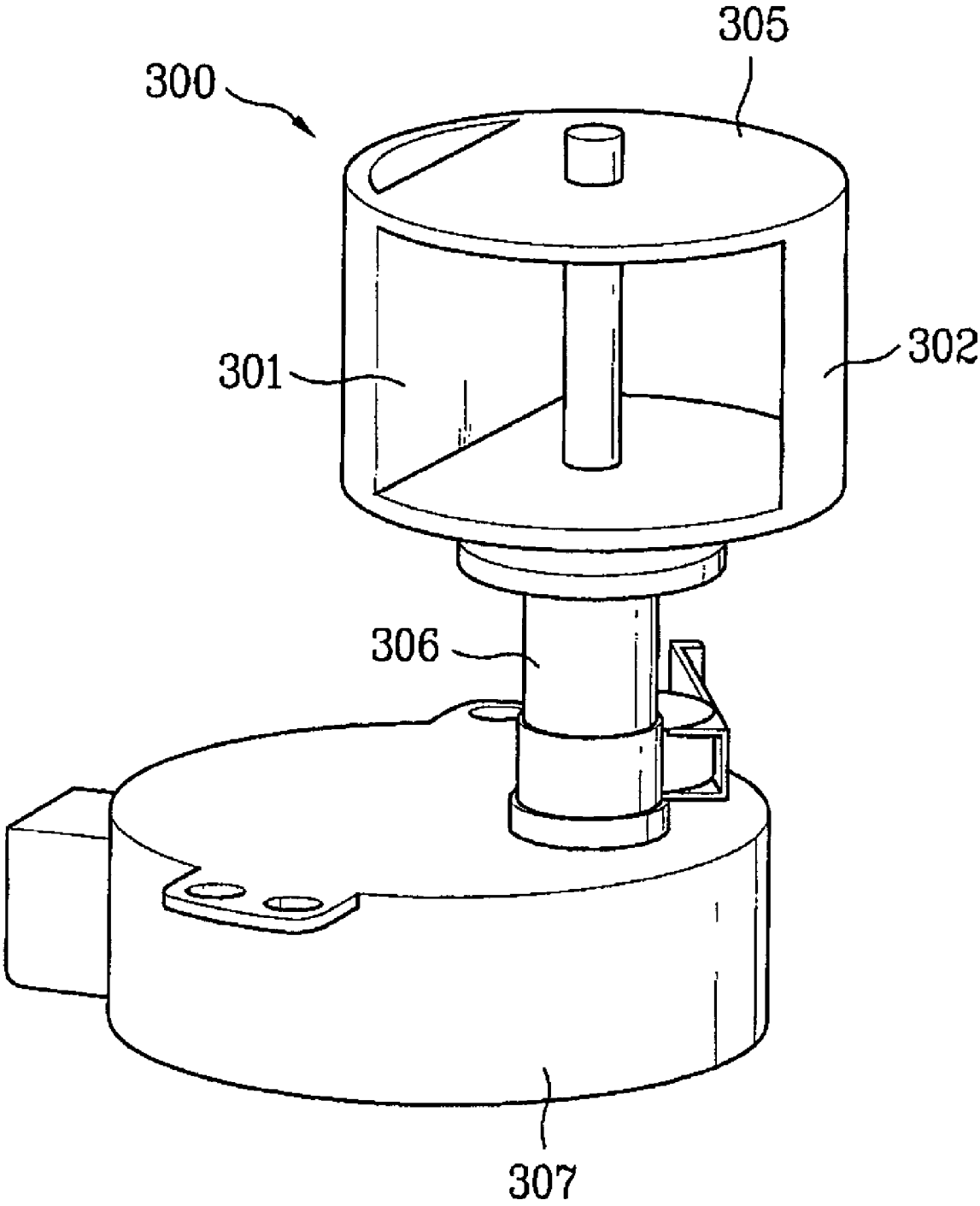
FIG. 9 is a perspective diagram of a rotary control valve according to the present invention.

Meanwhile, the rotary type control valve 300, as shown in FIG. 9, is configured to have a hollow cylindrical shape. And, the rotary type control valve is turned to selectively turn on/off each of the passages.

In particular, the rotary type control valve 300 includes a first partition wall 301 selectively closing one of the passages according to a rotation and a rotary portion 305 having a second partition wall 302 provided to a part opposing the first partition wall 301. In this case, the first and second partition walls 301 and 302 are spaced apart from each other to play a role as a passage.

A motor 307 is provided under the rotary portion 305. The rotary portion 305 connected to the motor 307 via a rotational shaft is selectively rotated. In this case, a selective rotation of the motor 307 is controlled by a control unit (not shown in the drawing).

The water, as shown in FIG. 8, introduced via the water introducing portion 171 is introduced into an introducing passage 311. And, the rotary type control valve 300 controlling a flow of the water is provided to a point at which the introducing passage 311 meets a pair of the water passages 176 and 177.

Preferably, a boundary wall 320 configuring each boundary between the passages is provide to the meting point with an angle of 120°. In particular, the passages 311, 312 and 313 are arranged with equal angles from centers of corresponding boundaries, respectively. Alternatively, in case that there exist at least three or more passages, the boundary walls 320 can be arranged with the equal intervals as many as the number of the passages.

So, as the rotary type control valve 300 is turned by about 120° or 240°, the first partition wall 301 closes one of the two water passages 312 and 313. In this case, the boundary walls 302 come into contact with both sides of the first partition wall 301, respectively. And, it is preferable that a sealing member is provided to one of the boundary wall 320 or the first partition wall 301 to prevent water leakage.

The second partition wall 302 provided to oppose the first partition wall 301 comes into contact with one of boundary walls 320. In this case, the space between the first and second partition walls 301 and 302 plays a role as a passage for enabling the water to flow. To guarantee a smooth low of the water, it is preferable that the opposing faces of the first and second partition walls 301 and 302 are rounded to configure a smooth streamline.

In this case, the rotary type control valve 300 is turned by being agitated right and left to supply the agitated water to the water passages 176 and 177. So, a wash cycle is carried out in a manner that the water passing through the passages is sprayed to tableware accommodated in upper and lower racks through upper and lower spray arms, respectively.

Meanwhile, one end of the introducing passage 311 is connected to a sampling passage 175. Preferably, the sampling passage 175 is provided along a rim of the garbage chamber 170. Through this, it is able to prevent the sampling passage 175 from narrowing an internal space of the garbage chamber 170. Hence, the garbage-containing water introduced into the garbage chamber can be purified more stably.

Besides, the sampling passage 175 always maintains an open state regardless of the rotation of the rotary type control valve 300. And, a portion of the water introduced via the water introducing portion keeps flowing the sampling passage 175.

Figure 10:
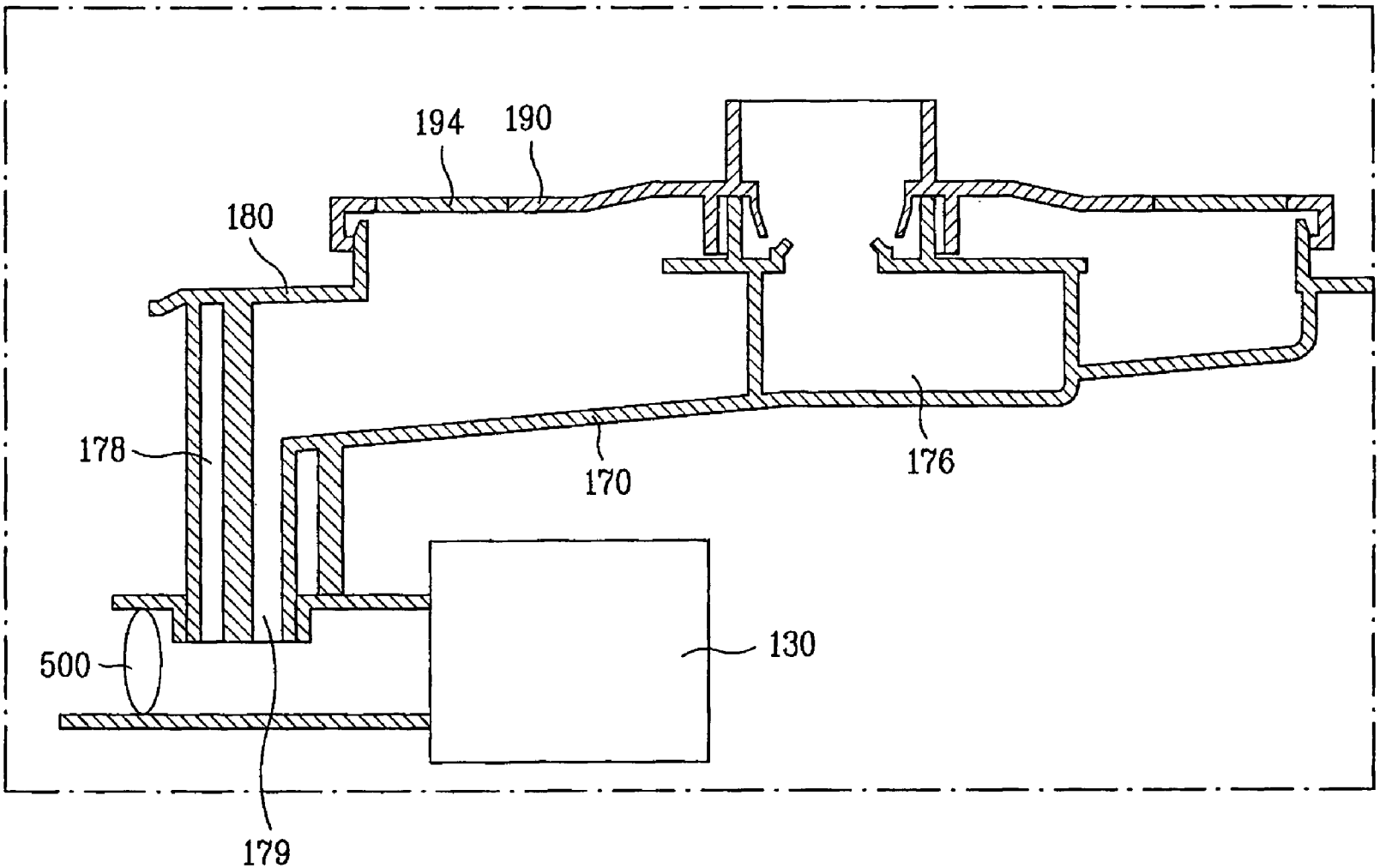
FIG. 10 is a cross-sectional diagram of a dishwasher according to the present invention.

A process of purifying the water introduced into the sampling passage is explained with reference to FIG. 4, FIG. 4 and FIG. 10 as follows.

First of all, the water supplied to the sampling passage 175 preferably falls onto the drain pump connecting portion ('125' in FIG. 4) provided to one side of the sump 120. In this case, large garbage contained in the water is accumulated on a lower side of the drain pump connecting portion 125. Besides, the garbage accumulated on the lower side of the drain pump connecting portion 125 is externally discharged together with the water if the drain pump 130 is driven in the course of a water discharge cycle after completion of a wash cycle of tableware.

Preferably, a check valve 500 is provided to the drain pump connecting portion 125 communicating with the drain pump 130 and the sump 120 to keep the water from being introduced into the sump 120 in case of a high pressure of the drain pump connecting portion. In particular, the check valve 500 is turned on only if the water is discharged to the drain pump 130 from the sump 120. And, the check valve 500 keeps the water from being introduced into the sump 120 from the drain pump connecting portion 125.

Meanwhile, the water having fallen onto the drain pump connecting portion is introduced into the garbage chamber 170 again along a recovery pipe 179 having a ring or dual pipe (duct) shape to enclose an outer side of the connecting pipe 178 with a prescribed gap.

The filter frame 180 and the filter housing 190 provided to an upper surface of the central part of the filter frame 180 are provided over the garbage chamber 170. In this case, the garbage chamber 170 and the filter housing 190 are fixed to each other by welding. Preferably, a support member 196 supporting and fixing a guide pipe connected to the upper spray arm is assembled to a central part of the filter housing 190 by being welded to the filter housing 190.

The filter 194 is provided to the filter housing 190 in a circumferential direction. The perforated holes 185 confronting the filter 194 are formed at the filter frame 180. And, a multitude of recovery holes 182 are formed on an edge of the filter frame 180 to communicate with the sump 120. So, the water introduced into the garbage chamber 170 overflows, passes through the filter 194 to be purified, and is then recovered to the sump 120 via the recovery holes 182.

Hence, a portion of the water is purified and is then sprayed on the tableware via the corresponding spray arm in the above-explained manner.

As mentioned in the foregoing description, one side of the garbage chamber 179 is connected to the drain pump 130 via the recovery pipe 179. In this case, it is preferable that a bottom surface of the garbage chamber 170, a shown in the drawing, is tilted toward the part where the recovery pipe 179 connected to the drain pump 130 is formed. Through this, after completion of the wash cycle, the water remaining in the garbage chamber 170 is facilitated to flow along the tilted bottom surface and is then introduced into the drain pump 130 via the recovery pipe 179 to be externally discharged.

Figure 11:
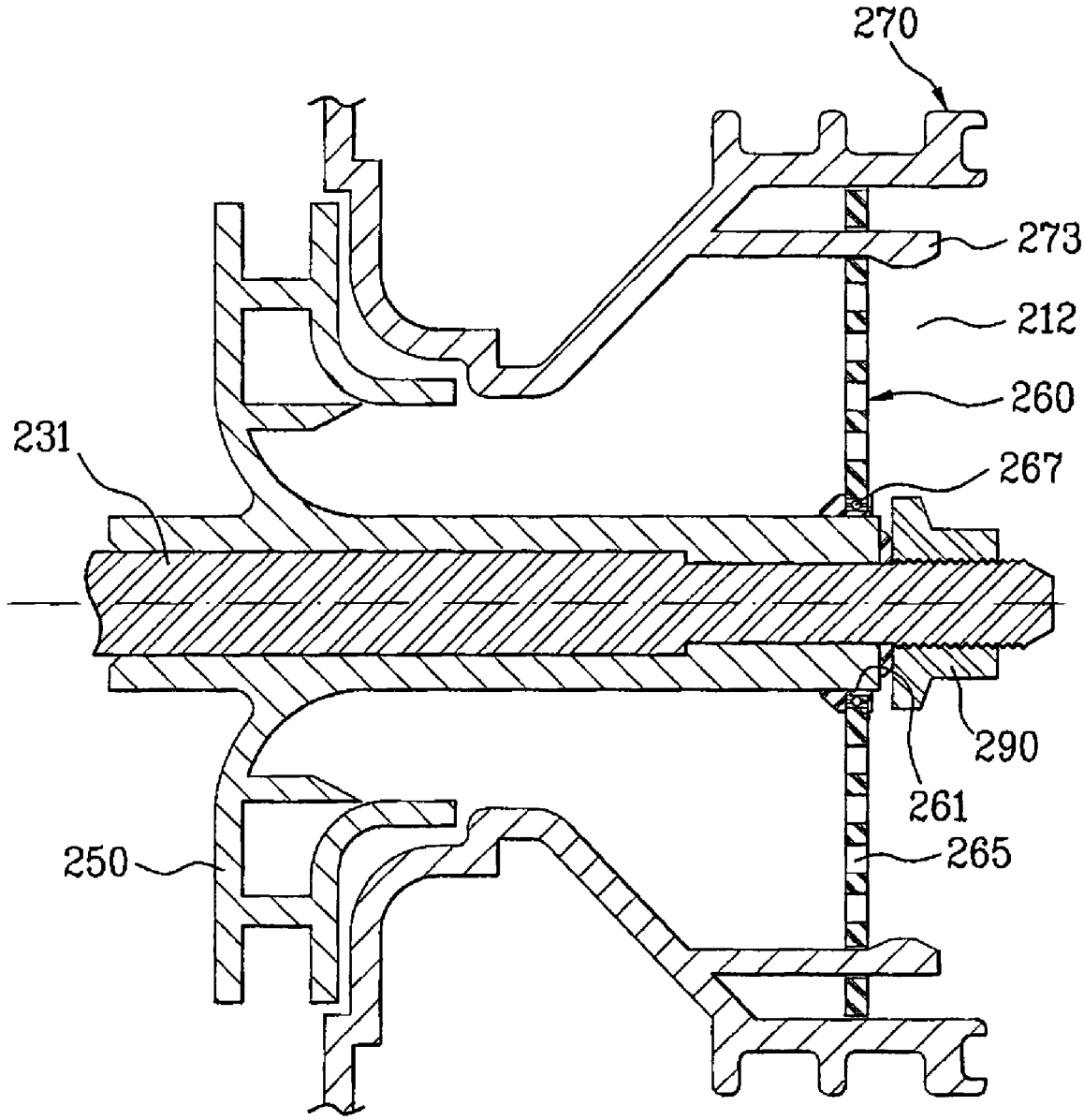
FIG. 11 is a cross-sectional diagram of an assembled screen of a dishwasher according to another embodiment of the present invention.

FIG. 11 is a cross-sectional diagram of an assembled screen of a dishwasher according to another embodiment of the present invention Referring to FIG. 11, the screen 260 is assembled within the pump inlet 212 by a hook 273 projected from an inside of the front casing 270.

A passing hole 261 is formed at a center of the screen 260 to be penetrated by a motor shaft 231 of a wash motor. A multitude of perforated holes 265 are formed around the passing hole 261 to enable water to be introduced via the perforated holes 265. And, a screen bearing 267 is provided to an inner circumference of the passing hole 261. In this case, the motor shaft 231 passing through an impeller 250 and the screen 260 is fixed by a nut 290.

optionally, at least one locking hole is formed at the screen 260 to enable a screw locking of the screen 260. And, at least one locking boss is formed inside the pump inlet 212 to oppose the at least one locking hole.

Accordingly, the dishwasher according to the present invention provides the following effects or advantages.

First of all, since the impeller housing of the wash pump is provided within the wash pump, a fabrication of the wash motor module is facilitated and an assembly structure of parts provided over the sump can be simplified. Compared to the related art that the related art impeller housing is separated to be assembled to the upper part of the sump, the present invention can reduce an overall height of the drive module of the dishwasher.

Secondly, since the inlet and outlet of the wash pump are provided parallel to each other, an overall height of the wash pump and the sump can be further reduced. So, the wash space within the tub can be increased for spatial efficiency.

Thirdly, the fixing holder facilitates the wash pump to be fixed more stably.

Fourthly, since it is unnecessary to assemble a separate impeller housing under the garbage chamber, it is facilitated to prevent the pumped water from leaking.

Fifthly, the water introducing portion, into which the water pumped by the wash pump is introduced, is outwardly projected from the discharge chamber and the sampling passage is provided in a periphery along the rim of the garbage chamber. So, the space for storing the water in the garbage chamber can be increased. Hence, the filter can occupy a wider area on the filter frame. And, a quantity of the water purified by the filter can be increased when the water overflows through the garbage chamber.

Sixthly, since the bottom surface of the garbage chamber is tilted, the water remaining in the garbage chamber is facilitated to flow along the tilted bottom surface and is then introduced into the drain pump via the recovery pipe to be externally discharged after completion of the wash cycle.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A dishwasher comprising:

a tub provided with a space in which items to be washed are received;

a sump provided in a tub bottom to accommodate water therein, wherein the sump includes a bottom wall and a side wall extending from the bottom wall to the tub bottom;

a base provided under the tub bottom to surround the sump and the tub bottom, wherein the base has a space formed between a lower surface of the tub bottom and an upper surface of the base;

a spray arm spraying the water to the items in the tub; and a wash pump provided in the space of the base to pump the water in the sump to the spray arm, wherein the wash pump is located in the space of the base and assembled to the side wall of the sump so as to be located in a space that is formed between the lower surface of the tub bottom and the side wall.

2. The dishwasher of claim 1, wherein the wash pump includes an inlet for sucking the water within the sump and an outlet for discharging the sucked water, and the side wall includes a connecting port that is connected to the inlet and a supply port that is connected to the outlet for supplying the discharged water from the outlet to the spray arm.

3. The dishwasher of claim 2, wherein the wash pump is assembled to the side wall of the sump in a manner of inserting the inlet and the outlet to the connecting port and the supply port, respectively.

4. The dishwasher of claim 1, the wash pump comprising:

a motor;

an impeller rotated by the motor; and an impeller housing accommodating the impeller.

5. The dishwasher of claim 4, the wash pump further comprising a front casing provided to a front side of the impeller housing, the front casing including an inlet sucking the water within the sump and an outlet discharging the sucked water into the sump.

6. The dishwasher of claim 5, the wash pump further comprising a screen that is provided to the inlet for filtering off garbage from the sucked water.

7. The dishwasher of claim 6, wherein a passing hole is formed at a center of the screen to enable a motor shaft of the wash pump to pass through the passing hole.

8. The dishwasher of claim 7, the wash pump further comprising a pulverizer pulverizing the garbage contained in the water introduced into the screen, wherein the pulverizer is provided to a front end of the screen to be rotated by the motor shaft of the wash pump.

* * * * *